US009441506B2

(12) United States Patent
Janitschek et al.

(10) Patent No.: US 9,441,506 B2
(45) Date of Patent: Sep. 13, 2016

(54) CAMSHAFT PHASER HAVING A SPRING

(75) Inventors: Josef Janitschek, Burgbernheim (DE); Juergen Weber, Erlangen (DE); Christinel-Viorel Rotaru, Localitatea Brasov (RO)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 26 days.

(21) Appl. No.: 13/983,987

(22) PCT Filed: Nov. 25, 2011

(86) PCT No.: PCT/EP2011/071004
§ 371 (c)(1),
(2), (4) Date: Aug. 6, 2013

(87) PCT Pub. No.: WO2012/107122
PCT Pub. Date: Aug. 16, 2012

(65) Prior Publication Data

US 2013/0324269 A1 Dec. 5, 2013

(30) Foreign Application Priority Data

Feb. 8, 2011 (DE) ..... 10 2011 003 769

(51) Int. Cl.
*F01L 1/34* (2006.01)
*F01L 1/344* (2006.01)

(52) U.S. Cl.
CPC ..... *F01L 1/344* (2013.01); *F01L 1/3442* (2013.01); *F01L 2001/34483* (2013.01)

(58) Field of Classification Search
CPC ..... F01L 2001/34483
USPC ..... 123/90.15, 90.17
See application file for complete search history.

(56) References Cited

U.S. PATENT DOCUMENTS

| | | | | |
|---|---|---|---|---|
| 7,140,341 | B2 | 11/2006 | Dahlberg | |
| 7,165,521 | B2 | 1/2007 | Nakajima | |
| 7,444,970 | B2 * | 11/2008 | Ogawa | 123/90.17 |
| 8,230,832 | B2 | 7/2012 | Isenberg et al. | |
| 2007/0266970 | A1 | 11/2007 | Ogawa | |
| 2009/0159829 | A1 * | 6/2009 | Hoppe et al. | 251/337 |
| 2009/0211549 | A1 * | 8/2009 | Myers et al. | 123/90.17 |
| 2010/0116233 | A1 * | 5/2010 | Weisser et al. | 123/90.17 |
| 2010/0154732 | A1 * | 6/2010 | Bayrakdar | 123/90.17 |
| 2010/0295222 | A1 | 11/2010 | Lee et al. | |

FOREIGN PATENT DOCUMENTS

| | | | |
|---|---|---|---|
| CN | 1892018 | | 1/2007 |
| CN | 101031703 | | 9/2007 |
| DE | 10361509 | A1 | 7/2004 |
| DE | 102007028187 | A1 * | 12/2008 |
| DE | 102008007561 | A1 * | 8/2009 |
| DE | 102008051755 | A1 | 4/2010 |
| EP | 1712779 | A2 | 10/2006 |
| EP | 1795715 | A1 | 6/2007 |
| EP | 2166199 | A1 | 3/2010 |

* cited by examiner

*Primary Examiner* — Thomas Denion
*Assistant Examiner* — Daniel Bernstein
(74) *Attorney, Agent, or Firm* — Davidson, Davidson & Kappel, LLC

(57) ABSTRACT

Provided is a camshaft phaser (1) having a driving member (2), a driven member (3), and a spring (4). The spring (4) is axially preloaded in the spring cavity (5).

15 Claims, 4 Drawing Sheets

A-A (Prior Art)

CAMSHAFT PHASER HAVING A SPRING

The present invention relates to a camshaft phaser for variably adjusting the valve timing of gas-exchange valves of an internal combustion engine, the camshaft phaser having a driving member, a driven member, and a spring.

BACKGROUND

Camshaft phasers are used in modern internal combustion engines for variably adjusting the valve timing of gas-exchange valves in order to allow the phase relationship between the crankshaft and the camshaft to be variably adjusted within a defined angular range between a fully advanced position and a fully retarded position. For this purpose, camshaft phasers are integrated into a drive train which serves to transmit torque from the crankshaft to the camshaft. This drive train may be implemented, for example, as a belt drive, chain drive or gear drive.

German Patent Document DE 10 2008 051 755 A1 discloses a vane-type camshaft phaser having a rotor, a stator, a driving wheel, a locking mechanism, and a spring. The stator is non-rotatably connected to the driving wheel. The locking mechanism couples and decouples the stator and the rotor, which are rotatable relative to one another, by engaging in a recess in the driving wheel. Moreover, the rotor and the driving wheel are provided with set screws to hold the spring. Relative rotation causes the spring to exert a torque in a direction opposite to the direction of relative rotation. The spring is in the form of a spiral spring which has radially extending coils and is disposed on the side facing away from the camshaft. The spring cavity surrounding the spring is bounded by a spring cover to counteract axial displacement of the spring. This ensures that the spring ends remain in position at the set screws, preventing them from slipping axially off the set screws due to the vibrations occurring during engine operation and thus from causing damage in the internal combustion engine. Because of resonance, the vibrations may cause spring coils to contact the surrounding boundaries of the spring cavity and be damaged by impulsive excitation.

SUMMARY OF THE INVENTION

It is an object of the present invention to arrange a spring in a camshaft phaser in an advantageous manner.

The present invention provides a camshaft phaser having at least one driving member and at least one driven member. The driving member is arranged to be rotatable within an angular range relative to the driven member. The spring is disposed in a spring cavity and is operatively connected to the driving wheel and the driven wheel via spring attachment elements. The spring cavity has axial boundary means which limit the degree of freedom of the spring. Vibrations occurring during engine operation or during rotation of the camshaft phaser itself cannot cause the attachment elements to axially slip off. The axial preload of the spring reduces the effect of the impulsive stress and increases the life of the spring.

In a hydraulic camshaft phaser, the driven member and the driving member form one or more pairs of oppositely acting pressure chambers, which can be pressurized with oil. The driving member and the driven member are arranged coaxially with respect to each other. The filling and emptying of individual pressure chambers produces relative movement between the driving member and the driven member. The spring acting rotatively between the driving member and the driven member urges the driving member in an advantageous direction relative to the driven member. This advantageous direction may be the same as or opposite to the direction of rotation.

Another construction of a camshaft phaser is the electromechanical camshaft phaser, which has a three-shaft gear system (e.g., a planetary gear system). Here, one of the shafts forms the driving member and a second shaft forms the driven member. Via the third shaft, rotational energy can be supplied to or removed from the system by means of an actuator, for example, an electric motor or a brake. There can also be provided a spring to assist in the relative rotation between the driving member and the driven member or to return them.

In all camshaft phaser designs, the spring is typically preloaded so that it provides a torque between the driven member and the driving member even when at rest. The torque acting during rotation may, for example, compensate for a friction torque acting on the camshaft. This friction torque is caused, for example, by bearing friction or by the friction between the cams and the cam followers. Alternatively or additionally, the spring may serve to move the driven member relative to the driving member to an emergency run position in the event of a failure of the actuating means (e.g., the pressure medium or the electric motor). In this case, a locking means may be provided to mechanically connect the driven member to the driving member when said position is reached. In this process, the spring may provide a torque between the driving member and the driven member over the entire adjustment range of the camshaft phaser, or only over portions of the adjustment range, such as, for example, between a fully retarded position and an emergency run or base position located between the extremes of the adjustment range.

The spring may be, for example, a flat spiral spring having axially or radially projecting ends for attachment to the driven member and the driving member. The coil body of a spring flat coil spring is formed by at least one coil and extends radially; i.e., substantially perpendicular to the axis of rotation of the camshaft phaser. A coil is defined by a slope in the winding direction of the spring and ends at a swept angle of 360°.

Alternatively, a torsion spring may be provided, the coils of which extend axially; i.e., substantially parallel to the axis of rotation.

In accordance with the present invention, when the spring is in the installed condition, there is an axial offset between at least two coils of its coil body in a direction substantially parallel to the axis of rotation of the camshaft phaser, such that an axial preload is generated between the axial boundary means located in the spring cavity. This minimizes or eliminates the production-related and heat-related play between the spring and its axial boundary means. Thus, the vibrations produced during operation will not cause any contact impacts between the spring and its surrounding components, which may affect the life of the spring or even damage it. Moreover, the spring is prevented from migrating axially on its attachment elements, thereby avoiding friction.

The spring may itself be produced with a defined offset from one coil to another. Due to space constraints, this offset is limited to the thickness of a wire. A larger offset is conceivable, but would be in conflict with the desired installation space. Moreover, if the offset is larger than the thickness of a wire, there is a risk of individual coils overlapping when the spring is tensioned during operation of the camshaft phaser, which may result in damage to the spring.

In one embodiment, the spring has a constant offset from one coil to another, which can be easily accomplished during manufacture. Each successive winding has an offset. It is preferred for the spring to have a simple, constant force-deflection characteristic in the axial direction.

Alternatively, the offset may vary between successive coils. The slope profile in the cross section of the coil body may be similar to the shape of a non-linear curve. The use of a non-linear variation of the offsets is useful for adapting the axial preload forces to the dynamic vibration characteristics for the particular operating ranges of the internal combustion engine.

In one specific embodiment of the spring, the offset of successive coils is not in the same direction, but changes its direction from one coil to another. This is advantageous in order to position specific contact zones of the preloaded springs in specific regions of the axial boundary means. In this connection, increased demands may be placed on the contact zones, while the non-contacted regions can meet lower requirements of production.

In another embodiment, only the first and the last coils of a oil body having a plurality of coils may be offset from the imaginary plane of the spiral spring. In this case, the two ends of the spring have a slope different from that of the remainder of the coil body. This provides the advantageous effect that only the spring ends experience axial contact and axial preloading, while the coil body that works during rotation remains unaffected by frictional effects.

In yet another embodiment of the present invention, the axial offset is created only in an angular portion of less than 360° of a coil. This is preferred for the formation of special regions for axial contact of the spring with the axial boundary elements. Thus, increased demands may be placed on the contact regions, while the non-contacted regions can meet lower requirements. This helps to reduce costs, save functional materials, and to reduce the area to be coated.

In a particularly advantageous embodiment of the present invention, the spring is manufactured substantially without a specific axial offset of the coils. The preload required to axially fix the spring in place without play is generated by means of the axial boundary means themselves. For this purpose, material protuberances or material accumulations in the spring cavity are used to tension the flat spiral spring during installation and to displace the coils with respect to one another. The axial displacement of at least one coil or the spring ends may alternatively be accomplished by means of additional components, such as, for example, pins, rivet heads, screw heads, disk springs, washers, or the like. Moreover, the spring attachment elements may themselves cause an axial displacement, and may integrally include axial boundary elements. An externally imposed, forced axial displacement of the coils produces the same desired advantageous effect of increasing the service life by axially fixing the spring in place using the flexibility of the coils thereof.

In one preferred embodiment of the present invention, the spring cover is used as an axial boundary means. This spring cover may either be substantially flat and may tension the prefabricated, offset coils during axial assembly, or it may have raised material portions that selectively displace specific coils of a flat spiral spring during the assembly process.

Alternatively, screw heads or undercuts on the spring attachment elements may also be used for this purpose. The screw heads or the undercuts of the spring attachment elements may either tension the spring that is prefabricated with offset coils during the assembly process, or press the coil body, in particular individual coils, against corresponding abutments of the peripheral components in the spring cavity during assembly so as to produce an axial preload in the spring. Ideally, it is possible to displace individual coils with respect to one another.

In a further embodiment of the present invention, the spring has only one coil, which has an axial offset. The axial offset may be created in the spring either during manufacture or during assembly in order to provide the appropriate preload force.

In a particularly advantageous embodiment, the spring and/or the contact points are provided with a wear-reducing coating to reduce friction during operation. This may be done over the entire spring or parts thereof. The contact points of the spring attachment elements, as well the contact points of the axial spring abutment, may also have a wear-reducing coating. It is also possible to selectively use wear-optimized materials and to provide such materials at the corresponding contact regions. Moreover, it is conceivable to coat the spring entirely or partially with plastic so as to limit the axial play of the spring, and thus counteract the axial vibrations and the resulting wear.

The present invention provides various embodiments for generating an axial preload of a spring in order to prevent damage to the spring caused by axial vibrations. This preload may be generated by an offset formed in the spring during manufacture and becomes effective by means of the axial boundary elements. Otherwise, in the case of a spring that is manufactured without an offset, this preload may also be generated during the assembly process by means of the axial boundary elements and possibly existing abutments. The effect of eliminating the play of the spring in the spring cavity, and thus of increasing the service life, is obtained in both embodiments.

BRIEF DESCRIPTION OF THE DRAWINGS

Exemplary embodiments of the present invention are shown in the figures, in which.

DETAILED DESCRIPTION

Figure 1:
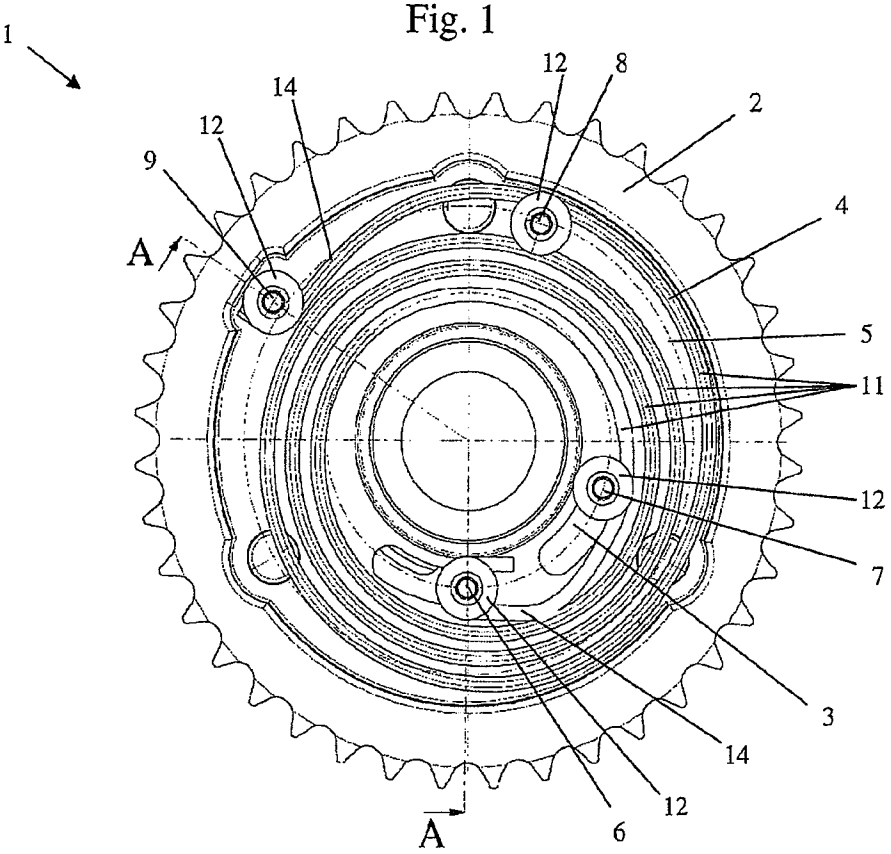
FIG. 1 is an end face view of a camshaft phaser 1.

FIG. 1 shows a camshaft phaser 1 having a driving member 2, a driven member 3, a spring 4, and a plurality of spring attachment elements 6, 7, 8, 9. Spring 4 is disposed in a spring cavity 5 provided for this purpose. Spring cavity 5 is formed mainly by driving member 2. Spring 4 has a plurality of coils 11 which extend substantially radially. The spring ends are held at spring attachment elements 6, 7, 8, 9. Spring attachment elements 6, 7, 8, 9 are fixedly connected in pairs to the respective driving member 2 and the respective driven member 3. Rotating driving member 2 circumferentially relative to driven member 3 causes tensioning of spring 4. Circumferential relative rotation is accomplished by means of pressure chambers (not shown) formed between driving member 2 and driven member 3. As in the vane-type phasers known from the prior art, the pressure chambers are pressurized with hydraulic oil as an actuating means.

Figure 2:
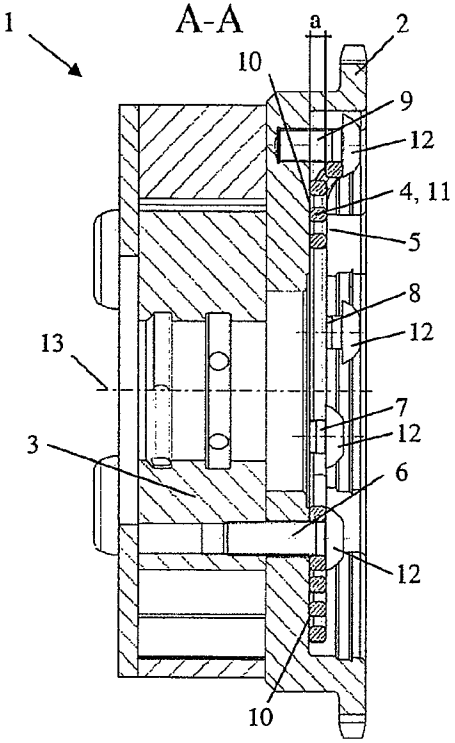
FIG. 2 is a cross-sectional view A-A of FIG. 1.

FIG. 2 illustrates a cross section along cross sectional line A-A of camshaft phaser 1 shown in FIG. 1. Driving member 2 and driven member 3 are concentric with axis of rotation 13 of camshaft phaser 1. In this example, spring attachment elements 6, 7, 8, 9 are in the form of cylinder head screws. Spring attachment elements 6 and 7 are connected to driven member 3, whereas spring attachment elements 8 and 9 are connected to driving member 2. Spring attachment elements 6, 7, 8, 9 have axial boundary means 12, which are formed by the screw head faces that face toward the thread. The complementary axial boundary means 10 is a flat end face of driving member 2. Spring 4 has an axial offset a formed between the last and the next-to-last coils 11. In the case of this spring 4, axial offset a was already formed during manufacture. Axial boundary means 10, 12 define spring cavity 5 in an axial direction along axis of rotation 13. Spring 4 is substantially concentric with axis of rotation 13.

During installation of spring 4, the spring ends are fixed via spring attachment elements 6, 7, 8, 9, and moreover, coils 11 are tensioned between axial boundary means 10 and 12 as the spring attachment elements 6, 7, 8, 9 are screwed in. In this process, coils 11 come to rest against the end face of driving member 2 and against the thread-side screw head faces of spring attachment elements 6, 7, 8, 9. The use of screws as axial boundary means 12 allows for adjustment of the offset a that was already formed during manufacture. In the uninstalled condition of spring 4, offset a is larger than in the installed condition. By tightening these screws, it is possible to adjust offset a, and thus also the desired preload force of spring 4.

Figure 3:
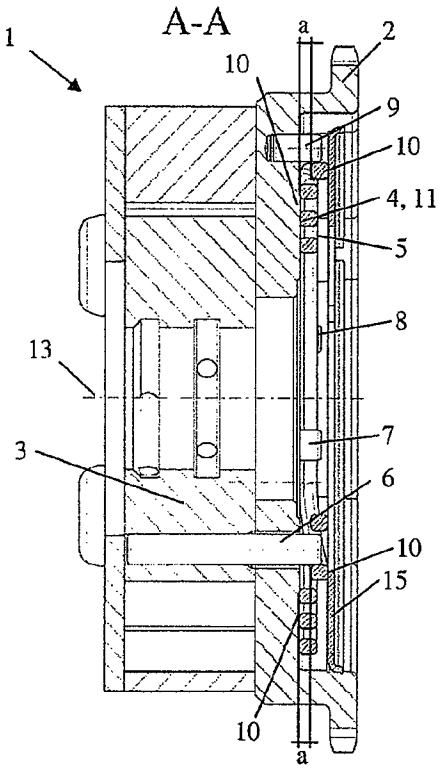
FIG. 3 is another cross-sectional view showing a similar camshaft phaser 1.

FIG. 3 shows an arrangement and a cross-sectional view similar to FIG. 2, with the difference that parallel pins are used as spring attachment elements 6, 7, 8, 9, and that a spring cover is used as an axial boundary means 12. Spring 4 differs from that shown in FIG. 2 in that it has an additional offset a between two additional coils 11. Axial boundary element 12, here in the form of a spring cover, defines its axial position via a groove formed in driving member 2.

Figure 4:
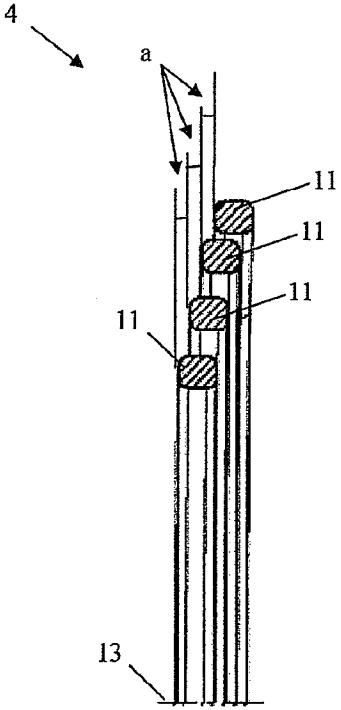
FIG. 4 is a half-sectional view of an exemplary embodiment of a spring 4.

FIG. 4 shows a half-sectional view of a spring 4 having a plurality of coils 11. Each of these coils 11 has an axial offset a, which in this case is constant. The cross-sectional profile of spring 4 resembles a cone. Here, offsets a are incorporated into spring 4 already during the manufacture thereof. It is also possible to conceive of an embodiment having different offsets a.

Figure 5:
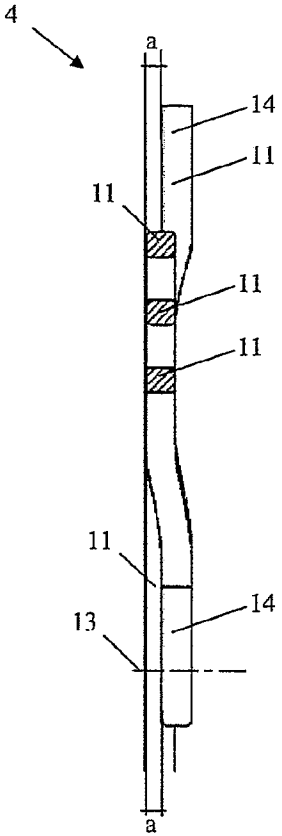
FIG. 5 is a partial view of another exemplary embodiment of a spring 4.

FIG. 5 shows another spring 4, which has an offset between the spring ends 14 and the respective preceding coils 11. Here, the two offsets of spring ends 14 are equal in size. This is advantageous for uniform axial engagement with boundary means 12 (not shown here). It is also conceivable for offsets a to be of different size.

Figure 6:
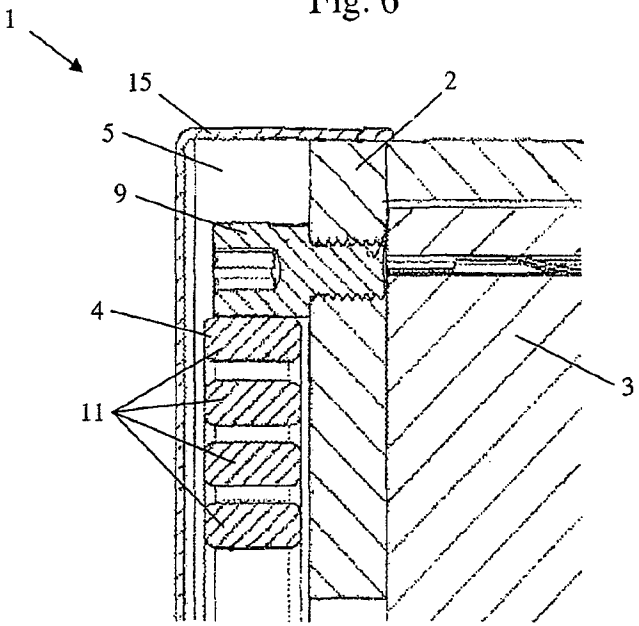
FIG. 6 is a detail view of a spring 4 according to the prior art.

FIG. 6 shows a spring 4 arranged in a spring cavity 5 according to the prior art. Spring 4 is secured to a spring attachment element 6 in the form of a cylinder head screw. Here, coils 11 have no intentional axial offset a. Therefore, there is axial play between spring 4 and the spring cover and the end face of driving member 2, respectively. Here, the vibrations produced can damage the spring.

LIST OF REFERENCE NUMERALS

1) camshaft phaser
2) driving member
3) driven member
4) spring
5) spring cavity
6) spring attachment element
7) spring attachment element
8) spring attachment element
9) spring attachment element
10) axial boundary means
11) coils
12) axial boundary means
13) axis of rotation
14) spring end
15) spring cover
a) offset (axial)

What is claimed is:

1. A camshaft phaser comprising:
a driving member;
a driven member; and
a spring disposed in a spring cavity;
the driving member and the driven member being arranged to be rotatable relative to one another about an axis of rotation of the camshaft phaser;
the driving member and the driven member having spring attachment elements to which the spring is operatively connected;
the spring imparting a torque between the driving member and the driven member via the spring attachment elements;
the spring having a plurality of coils extending radially and the spring cavity being at least partially defined by axial boundaries for axially fixing the spring in place;
at least one coil of the spring has an axial offset from another coil, an axial preload of the spring being generated between the axial boundaries.

2. The camshaft phaser as recited in claim 1 wherein all coils of the spring have an offset from one another.

3. The camshaft phaser as recited in claim 1 wherein the axial offset is constant for all coils.

4. The camshaft phaser as recited in claim 1 wherein the axial offset is limited to an angular portion of the offset coil.

5. The camshaft phaser as recited in claim 1 wherein the axial offset between the coils is created by the axial boundaries.

6. The camshaft phaser as recited in claim 1 wherein one of the axial boundaries is a spring cover.

7. The camshaft phaser as recited in claim 1 wherein contact points of the spring are provided with a wear-reducing coating.

8. The camshaft phaser as recited in claim 1 wherein the spring is provided with a wear-reducing coating.

9. The camshaft phaser as recited in claim 1 wherein the spring attachment elements include the axial boundaries.

10. A spring of a camshaft phaser as recited in claim 1.

11. The camshaft phaser as recited in claim 1 wherein the spring attachment elements are screws.

12. The camshaft phaser as recited in claim 11 wherein the screws have screw heads with faces facing threads of the screw, the axial boundaries formed by the faces.

13. A camshaft phaser comprising:
a driving member;
a driven member;
a spring disposed in a spring cavity; and
axially boundary means at least partially defining the spring cavity;
the driving member and the driven member being arranged to be rotatable relative to one another about an axis of rotation of the camshaft phaser;

the driving member and the driven member having spring attachment elements to which the spring is operatively connected;

the spring imparting a torque between the driving member and the driven member via the spring attachment elements;

the spring having a plurality of coils extending radially, the axially boundary means for axially fixing the spring in place;

at least one coil of the spring has an axial offset from another coil, an axial preload of the spring being generated between the axial boundary means.

14. The camshaft phaser as recited in claim 13 wherein the spring attachment elements are screws.

15. The camshaft phaser as recited in claim 14 wherein the screws have screw heads with faces facing threads of the screw, the axial boundary means formed by the faces.

* * * * *